United States Patent [19]

Browne et al.

[11] Patent Number: 4,489,503

[45] Date of Patent: Dec. 25, 1984

[54] PROCESS FOR DRYING WET PARTICLES OF AVAILABLE HALOGEN COMPOUNDS

[75] Inventors: James H. Browne; Robert H. Ward, both of Lake Charles, La.; Frank E. Albus, Willow Grove, Pa.

[73] Assignee: Olin Corporation, Cheshire, Conn.

[21] Appl. No.: 210,698

[22] Filed: Nov. 28, 1980 (Under 37 CFR 1.47)

[51] Int. Cl.[3] ..... F26B 3/10

[52] U.S. Cl. ..... 34/10; 34/57 R; 34/57 E

[58] Field of Search ..... 34/10, 57 R, 102, 57 E; 544/187, 188, 190; 8/650; 252/187 C, 187 H

[56] References Cited

U.S. PATENT DOCUMENTS

| | | | |
|---|---|---|---|
| 3,667,131 | 6/1972 | Stephanoff | 34/57 R |
| 3,755,913 | 9/1973 | Koller et al. . | |
| 3,951,972 | 4/1976 | Nelson et al. | 34/57 R |
| 3,958,342 | 5/1976 | Stephanoff | 34/57 R |
| 3,991,480 | 11/1976 | Menge | 34/57 R |
| 4,226,027 | 10/1980 | Albus | 34/57 R |

*Primary Examiner*—Larry I. Schwartz

*Attorney, Agent, or Firm*—Donald F. Clements; James B. Haglind

[57] ABSTRACT

A process for drying wet particles of an available halogen compound which comprises:

a. forming a substantially vertical circulating bed of dried particles of said available halogen compound suspended in a heated gas in a circular annular zone, said zone having an exterior perimeter and an interior perimeter and having contiguous sections comprised of a top, a feed side, a bottom and a dryer side, b. feeding wet particles of said available halogen compound into said circulating bed from the exterior perimeter of said feed side, c. feeding additional heated gas tangentially into said zone from the exterior perimeter of said bottom, the velocity of said heated gas being sufficient to maintain said circulating bed in said zone, d. withdrawing a product portion from said circulating bed from the interior perimeter of said feed side, downstream from said top, and e. recovering said dried particles of available halogen compound from said product portion.

15 Claims, 2 Drawing Figures

PROCESS FOR DRYING WET PARTICLES OF AVAILABLE HALOGEN COMPOUNDS

This invention relates to a process for drying available halogen compounds. Available halogen compounds are used commercially as sanitizing agents, disinfectants and bleaching agents.

In the commercial production of available halogen compounds such as calcium hypochlorite, chloroisocyanurates and bromoisocyanurates, a slurry is obtained which is further treated to obtain a dry granular product. In one method, the slurry is filtered or centrifuged to produce a wet cake containing varying amounts of water. This cake is then dried in a suitable dryer to produce a granular product. Since these compounds are thermally sensitive, they may readily lose available halogen during the drying process. In addition, many of these compounds form granular products which are easily abraded and form excessive amounts of "fines" or dust. For these and other reasons, careful consideration has been given in the prior art to methods of drying these compounds.

In U.S. Pat. No. 2,195,754, issued Apr. 2, 1940, to H. L. Robson, the production of calcium hypochlorite granules is accomplished by partially drying a wet cake, compressing the partially dried material between heavy rolls to form compressed flakes and then further drying the compressed flakes. Drying of the compressed flakes is carried out under gentle handling conditions in a rotary vacuum dryer or a tray dryer which is commonly used to minimize dust formation and entrainment in the drying atmosphere. Drying rates in these types of dryers are relatively slow. Because of the sensitivity of calcium hypochlorite to thermal degradation, the losses of available chlorine are relatively high in these types of dryers.

In another drying method which utilizes a spray dryer, a liquid slurry of a chlorinated isocyanuric acid or calcium hypochlorite is sprayed into a heated gas stream in which the water is vaporized and a dry product recovered. While this method may avoid a separation step and reduce the drying time, it requires a relatively large volume of gas at very high temperatures to dry the available chlorine compounds because of the amount of water present. In addition, the spraydryer is objectionable because of the lack of uniform drying of different sized particles. Larger, heavier particles fall more rapidly through the heated gas and are dried for shorter periods while smaller, lighter particles remain suspended in the gas stream and are dried for longer periods of time, resulting in products having variable moisture content. Further, spraydrying forms hollow, highly porous particles of low density which may not stand severe handling conditions without excessive dusting. Spray drying techniques for preparing available halogen compounds are described, for example, in U.S. Pat. No. 2,901,435, issued Aug. 25, 1959, to H. L. Robson and U.S. Pat. No. 2,913,460, issued Nov. 17, 1959, to A. G. Brown et al.

A third drying method uses a flash dryer to dry particles of a wet cake of the available halogen compound, which are dispersed into a rapidly moving stream of heated gas, as described, for example, in U.S. Pat. No. 3,951,972, issued Apr. 20, 1976, to G. D. Nelson et al. The particles of wet cake are dried rapidly and contact time between the particles and heated gas is minimized. However, this method requires mixing of a large recycle bed of dry product with the particles of wet cake to obtain a suitable feed mixture for the flash dryer. In addition, flash dryer design normally utilizes an arch component for breaking up agglomerates of wet cake to complete drying of the resulting fractured agglomerates. When the velocity of the particles and the temperature of the drying gas are too low, there is build up of undried wet cake in the arch of the flash dryer. Plugging of the arch eventually occurs and considerable down time is necessary to remove the arch and clean it. In addition, the build up of nitrogen trichloride in the wet cake adhering to the arch creates an explosion hazard.

Therefore, there is a need for an improved process which provides more uniform drying of particles of available halogen compounds having variable particle sizes, while minimizing the loss of available halogen caused by thermal decomposition.

It is an object of the present invention to provide a process for uniformly drying available halogen compounds of varying particle size.

Another object of the present invention is to provide a process for drying available halogen compounds which permits the use of variable feed rates of the available halogen compounds.

A further object of the invention is to provide an improved process for drying particles of available halogen compounds, utilizing feed particles of variable moisture content.

Still another object of the invention is to provide an improved process for drying particles of wet cake of an available halogen compound wherein blockage of the interior dryer surfaces by caking of the wet cake particles is avoided.

These and other objects of the invention are accomplished in a process for drying wet particles of an available halogen compound which comprises:

a. forming a substantially vertical circulating bed of dried particles of said available halogen compound suspended in a heated gas in a circular annular zone, said zone having an exterior perimeter and an interior perimeter and having contiguous sections comprised of a top, a feed side, a bottom, and a dryer side, b. feeding wet particles of said available halogen compound into said circulating bed from the exterior perimeter of said feed side, c. feeding additional heated gas tangentially into said zone from the exterior perimeter of said bottom downstream from said feed side, the velocity of said additional heated gas being sufficient to maintain said circulating bed in said zone, d. withdrawing a product portion from said circulating bed from the interior perimeter of said feed side downstream from said top, and e. recovering said dried particles of available halogen compound from said product portion.

Figures 1, 2:
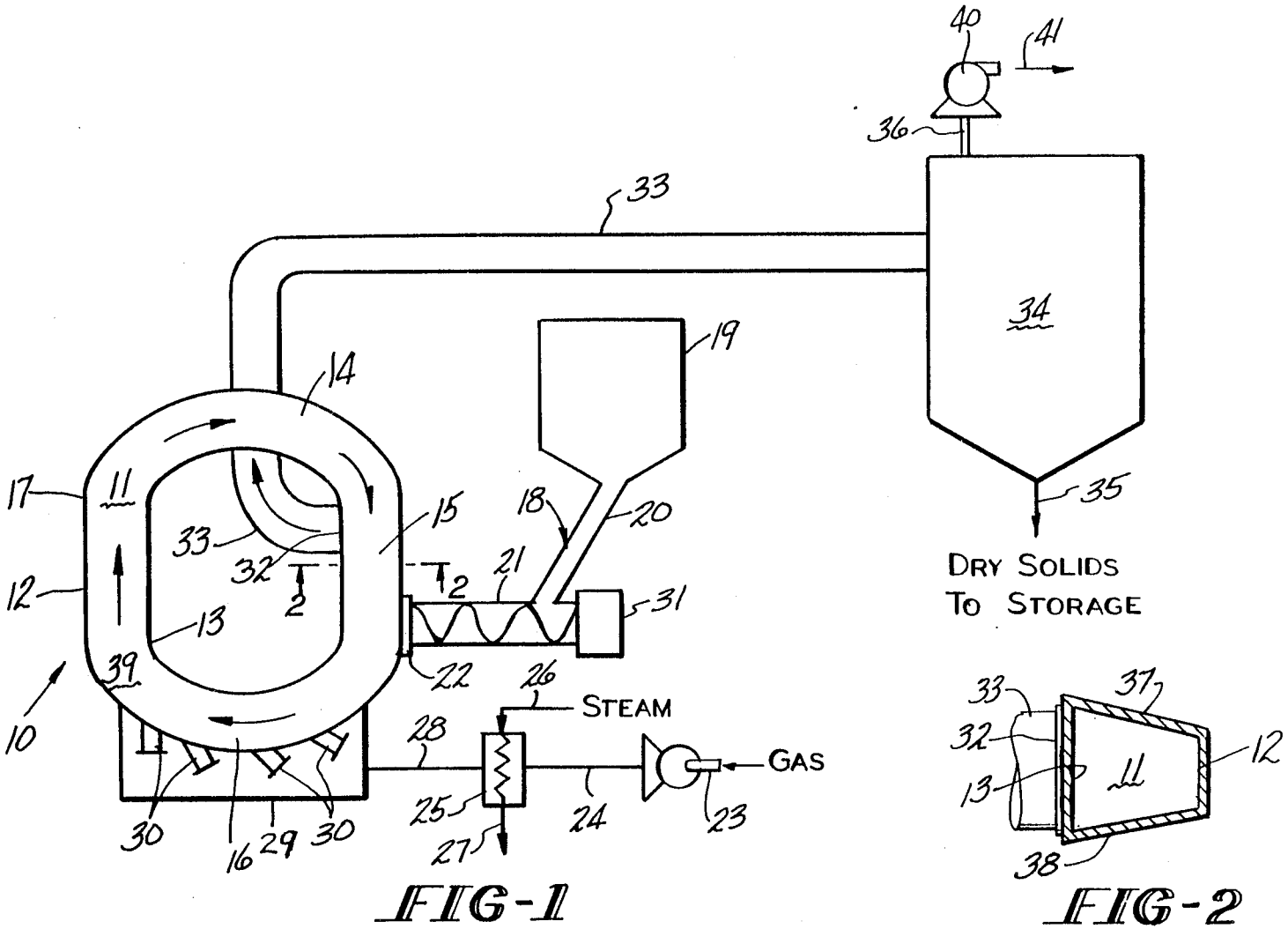
FIG. 1 shows a schematic flow diagram for carrying out the process of this invention wherein wet particles of an available halogen compound are dried in a circular annular zone.
FIG. 2 is a schematic cross sectional view of the annular zone through lines 2—2 of FIG. 1.

More in detail, wet particles of available halogen compound are dried in the process of this invention by contacting a substantially vertical circulating bed of particles of the available halogen compound with heated gases while suspended in a circular annular zone.

A typical apparatus useful for drying the particles in this manner is shown schematically in FIG. 1 as circular vertical dryer 10.

Dryer 10 is comprised of a hollow circular chamber 11 having an exterior perimeter 12 and an interior perimeter 13. Hollow circular chamber 11, forms an annular heating zone 39 which is essentially circular in shape, having contiguous sections comprised of a top 14, a feed side 15, a bottom 16, and a dryer side 17, in clockwise order.

Feed side 15 is provided with a feeding means 18 which is comprised of a hopper 19 for collecting wet particles of the available halogen compound from the filter (not shown), inclined chute 20 connected to the bottom of hopper 19, and screw feeder 21 which conveys the wet particles from chute 20 to dryer 10. Motor 31 operates screw feeder 21, which is preferably Teflon coated to convey the wet particles to dryer feed inlet 22 located on exterior perimeter 12 of feed side 15. Although dryer feed inlet 22 is shown schematically as being perpendicular to feed side portion 15, it is preferred that dryer feed inlet 22 be positioned tangentially to feed side portion 15 to feed the wet particles into dryer 10 in the direction of flow of the circulating bed. The direction of flow of the circulating bed of dried particles is shown by the arrows in hollow circular chamber 11.

A circulating bed of dried particles of available halogen compound is first established in hollow circular chamber 11 by suspending wet particles in a heated gas such as air or nitrogen. Gas under ambient conditions is conveyed through blower 23, through gas feed inlet line 24 to heat exchanger 25. Superheated steam is fed to heat exchanger 25 through steam inlet 26 where is contacts the gas fed through gas inlet line 24 and heats it to the desired temperature range. The resulting steam condensate is discharged from heat exchanger 25 through condensate discharge line 27. The heated gas is conveyed from heat exchanger 25 through heated gas feed line 28 to a distributor box 29 positioned at the bottom 16 of dryer 10. A plurality of nozzles 30 are positioned tangentially in bottom 16 for conveying the heated gas from distributor box 29 into the eterior perimeter 12 of bottom 16. The nozzles are positioned to feed the heated gas tangentially into hollow circular chamber 11 to move the circulating bed of suspended solids in the direction of the arrows. Sufficient velocity is imparted to the heated gas as it enters hollow circular chamber 11 through nozzles 30 to maintain the circulating bed of dry particles plus the freshly fed wet particles in constant motion through hollow circular chamber 11.

As wet particles enter hollow circulating chamber 11 at dryer feed inlet 22, they are entrained in recirculating heated gas and are carried with the heated gas in a continuous circular path from feed side 15 to bottom 16, dryer side 17 to top 14, back to feed side 15 until substantially dry. The wetter, heavier particles by centrifugal force, travel around hollow circular path 11 adjacent to exterior perimeter 12. As contact time between the wet particles and the heated gas increases, more water is vaporized from the particles, and agglomerates are broken down. The resulting drier, lighter particles gradually move towards interior perimeter 13.

Discharge outlet 32 located on feed side 15 at interior perimeter 13, removes a portion of the dry solids from the circulating bed adjacent to interior perimeter 13. These removed solids are suspended in heated gas of lower temperature and higher water content than heated gas fed through nozzles 30. The suspension of dry solids in gas is conveyed through conduit 33 to settling vessel 34 where dry solids settle from the gas and are removed through solids discharge line 35. Gas is removed from settling vessel 34 by means of gas line 36 and exhaust blower 40, and discharged through discharge line 41. Dry solids from solids discharge line 35 may be further cooled, conveyed to packaging, storage, or otherwise disposed of. Gas from discharge line 41 may be discharged to the atmosphere, or recycled to a suitable heat exchanger such as heat exchanger 25 for heating and dehumidification, and then recycled for feed to circular vertical dryer 10.

The portion of the dry solids which pass discharge outlet 32 entrain additional wet particles fed through dryer feed inlet 22 and continue travelling around in the circulating bed until they are removed through discharge outlet 32.

FIG. 2 shows a schematic cross section of hollow circular chamber 11 through lines 2—2 of FIG. 1. This figure shows the trapezoidal or toroidal configuration of the cross section of the hollow circular chamber 11. This configuration is selected because of the ease of construction and because of improved performance of resulting dryer 10. However, elliptical, circular, rectangular, square, or triangular forms or mixtures thereof can be used as cross section configurations of hollow circular chamber 11. Hollow circular chamber 11 is formed of exterior perimeter 12, side perimeters 37 and 38 and interior perimeter 13. Discharge outlet 32 is located in interior perimeter 13, for conveying dry solids to discharge conduit 33.

Available halogen compounds which are dried by the process of this invention include those compounds having available chlorine atoms, available bromine atoms, and mixtures thereof, and which liberate iodine from an acidified iodide solution. Specific examples of suitable available halogen compounds which can be dried by the process of the present invention include alkali metal hypochlorites such as lithium hypochlorite and alkaline earth metal hypochlorites such as calcium hypochlorite and dibasic magnesium hypochlorite, metal hypobromites such as lithium hypobromite and calcium hypobromite tetrahydrate. Other suitable compounds include N-chloro organic compounds such as trichloroisocyanuric acid, dichloroisocyanuric acid, sodium dichloroisocyanurate, potassium dichloroisocyanurate and complexes thereof, calcium dichloroisocyanurate, magnesium dichloroisocyanurate, and other dichloroisocyanuric acid salts, including heavy metal salts and double salts. In addition, N-chloro compounds including 1,3-dichloro-5,5-dimethylhydantoin, chloramine T, dichloramine T, N-chlorosuccinimide, N,N'-dichlorobenzolylene urea, trichloromelamine, and 1,3,4,6-tetrachloroglycoluril can be used.

Similarly, N-bromo organic compounds can be employed including tribromocyanuric acid, dibromocyanuric acid, and salts thereof, such as sodium dibromocyanurate and potassium dibromocyanurate. Other N-bromo compounds may also be used, such as N-bromosuccinimide, N-bromomalonimide, N-bromophthalimide and N-bromonaphthalimide as well as the hydantoins, such as 1,3-dibromo-5,5-dimethylhydantoin; N-monobromo-,C-dimethylhydantoin; methylene-bis(N-bromo-C,C-dimethylhydantoin); 1,3-dibromo-5-isobutylhydantoin; 1,3-bromo-5-methyl-5-ethylhydantoin; 1,3-dibromo-5,5-diisobutylhydantoin; 1,3-dibromo-5-methyl-5-n-amylhydantoin, and the like.

Also, if desired, compounds in which two or more available halogens are present can be used, such as, for example, N-bromo,N'-chlorocyanuric acids and salts thereof, e.g., 1-monobromo-3,5-dichlorocyanuric acid, 1,3-dibromo-5-monochloro-cyanuric acid, 1-monobromo-3-monochlorocyanuric acid, sodium-1-monobromo-3-monochlorocyanurate, potassium-1-monobromo-3-monochlorocyanurate; and N-brominated, N-chlorinated hydantoins, e.g., N-bromo-N-chloro-5,5-dimethylhydantoin and N-bromo-N-chloro-5-ethyl-5-methyl hydantoin. Preferred available halogen compounds dried by the process of this invention are trichloroisocyanuric acid, dichloroisocyanuric acid, sodium dichloroisocyanurate, cyanuric acid, potassium dichloroisocyanurate, and calcium hypochlorite. While it is recognized that cyanuric acid is not literally an "available halogen compound", it is a precursor of available halogen compounds such as trichloroisocyanuric acid and the other alkali metal salts thereof. Therefore, the "available halogen compound", as used throughout the description and claims, is intended to include cyanuric acid.

These available halogen compounds are generally produced in a variety of halogenation processes in which a thick slurry of the available halogen compound is recovered. For example, haloisocyanuric acids such as chloroisocyanuric acids are produced by the reaction of an aqueous slurry of cyanuric acid or an alkali metal cyanurate with a chlorinating agent such as hypochlorous acid, an alkali metal hypochlorite or chlorine. Proper selection of the stoichiometric amounts of chlorinating agent and cyanuric acid will result in an aqueous slurry of dichloroisocyanuric acid or trichloroisocyanuric acid. This slurry is concentrated, for example, by filtering or centrifugally to provide a wet cake in granular form suitable for use as feed for the novel drying process of this invention. U.S. Pat. Nos. 2,956,056; 2,964,525; 2,969,360; 2,975,178; 3,073,083; 3,178,429; 3,189,609; 3,534,033; 3,668,204; 3,712,891; 3,835,134; and 3,835,135; exemplify suitable processes for producing thick slurries of chloroisocyanuric acid and their salts. It is preferred to prepare trichloroisocyanuric acid in the presence of an organic promoter of crystal growth such as the alkali metal alkyl sulfates and alkali metal alkylaryl sulfonates disclosed in U.S. Pat. No. 3,453,274; the polyoxyethylene, polyoxypropylene, and copolymers thereof disclosed in U.S. Pat. No. 3,941,784 and the alkali metal salts of alkyl esters of dicarboxylic acid, sulfonated alkyl esters of dicarboxylic acid, and ethylene oxide terminated alkoxylated alcohols having a cloud point of up to about 50° C., as disclosed in U.S. Pat. No. 4,220,768.

Similarly, bromoisocyanurates can be produced by processes described, for example, in U.S. Pat. No. 3,121,715 and British Patent No. 933,631. Haloisocyanurates containing both N-bromo and N-chloro substituents can be produced using the methods, for example, taught in U.S. Pat. Nos. 2,868,787; 3,345,371; and 3,147,259.

Alkaline earth metal hypochlorites such as calcium hypochlorite are produced by a variety of known processes including the triple salt process, the reaction of hypochlorous acid with a lime slurry, and the chlorination of dibasic calcium hypochlorite. These processes and others suitable for producing calcium hypochlorite are described, for example, in U.S. Pat. Nos. 1,787,080; 3,134,641; 3,572,989; and 3,954,948.

The available halogen compound to be dried by the process of the present invention is in the form of wet particles. The term "wet particles" is used throughout the description and claims to describe particles of an available halogen compound containing free water. The free water in the particles of available halogen compound used as feed to the process of this invention is generally in the range from about 5 to about 50, and preferably from about 7 to about 30 percent by weight of free water. Some variation may occur among the available halogen compounds. For example, suitable wet particles of chloroisocyanuric acids, their salts, and precursors thereof preferably contain from about 7 to about 20 percent by weight of free water, while calcium hypochlorite slurries to be dried preferably contain from about 20 to about 30 percent by weight of free water. The preferred moisture content of wet particles of trichloroisocyanuric acid is in the range from about 12 to about 15 percent by weight of free water. While water or aqueous solutions frequently make up the free water content of the wet particles of available halogen compounds, non-aqueous solvents may also be removed by the process of this invention.

The particles of wet cake of available halogen compound are conveyed from the filter, centrifuge, or other wet cake forming operation by feeding means 18 to hollow circular chamber 11. The wet particles are agglomerated crystals of the available halogen compound containing aqueous reaction solution. The wet particles are continuously conveyed from hopper 19 down inclined chute 20 and through screw feeder 21 into dryer feed inlet 22. At start-up, substantially all of the wet particles fed to dryer 10 are dryed and removed through discharge outlet 32 without recyle. As the drying process continues, or if the feed rate is increased, from about 3 to about 30 and preferably from about 5 to about 15 percent by weight of the dry solids are recycled past discharge outlet 32.

As the wet particles are fed into dryer feed inlet 22, the wet particles are entrained in the circulating bed of hot gas travelling in a substantially circular path in hollow circular chamber 11.

The heated gas used as the drying agent and carrier for the circulating bed of particles of available halogen compound is a gas such as air, nitrogen, or mixtures thereof. Other gases which are compatible or substantially non-reactive with the available halogen compounds dried by the process of the present invention may also be used. Since, the available halogen compounds are heat sensitive, the hot gas is fed to the drying apparatus at a temperature below that which the available halogen compound being dried will undergo significant thermal decomposition. For example, when drying wet particles of trichloroisocyanuric acid, the inlet temperature of the hot gaseous fluid is in the range of from about 100° to about 220° C., and preferably from about 150° to about 205° C., which is below the temperature range of 225°-230° C. where thermal decomposition of trichlorocyanuric acid begins to take place. The relative humidity of the heated gas should be low, for example, below about 40 percent and preferably below about 10 percent in order to enhance the drying efficiency of the dryer.

To transport the wet particles through the circular, annular zone, the heated gas is introduced into the annular path tangentially through at least two, and preferably a plurality of inlets at suitable pressures. The pressure of the heated gas generally ranges from about 0.02 to about 0.2 and preferably from about 0.05 to about 0.15 kilograms per square centimeter. The inlets are equipped with nozzles to spray the heated gas at a velocity high enough to impart sufficient energy to the circulating dry particles and the wet patticles feed to cause circulation of the particles in the circular annular zone, while breaking up the agglomerates of wet particles into dry crystals.

As the wet particles enter the dryer from dryer feed inlet 22, energy is imparted to the particles by the circulating bed and hot gases entering through nozzles 30. The wet particles become entrained in the circulating bed and the temperature of the particles immediately increases due to contact with the hot gases. The wet particles, because of the higher density and larger particle size initially travel near exterior perimeter 12 by centrifugal force. During this circulation, the agglomerates are impacted with other agglomerates while in contact with the drying gases and disintegration of the agglomerates into dry particles effected. The resulting dry crystals of available halogen compound, because of the lack of free water and smaller particle size are low in mass, and they gravitate by centrifugal force to interior perimeter 13 while travelling in the circulating bed.

A product portion of the circulating bed travelling adjacent to interior perimeter 13 is continuously withdrawn through discharge outlet 32 and conveyed through discharge conduit 33 to a suitable solids-gas separator such as settling vessel 34. Discharge outlet 32 may be located at any convenient position on interior perimeter 13, but is preferably located on feed side 15 up-stream and adjacent to dryer feed inlet 22. This configuration permits wet particles fed through inlet 22 to have maximum contact with the heated gases in hollow circular chamber 11 before exiting through discharge outlet 32. In a preferred embodiment, as shown in FIG. 2, discharge outlet 32 is located on interior perimeter 13. If desired, discharge outlet 32 could also be located on side 37 or side 38 at a point adjacent to interior perimeter 13.

The proportion of solids removed in the product portion generally corresponds to the weight of the solids, on a dry basis, fed as wet particles to the dryer after equilibrium of operation has been established. The rate of discharge of the product fraction can be controlled by exhaust blower 40 as well as the feed rate of wet particles to the dryer.

Exhaust blower 40 provides enough suction to convey product portion through discharge outlet 32 and discharge conduit 33 to settling vessel 34. Settling vessel 34 which may be a cyclone or bag collector, separates dry particles of the available halogen compound from the cooled gas which passes to exhaust through gas line 36. Dry particles of the available halogen compound recovered in settling vessel 34 are discharged through solids discharge line 35 and conveyed to a suitable storage facility.

The temperature of the cooled gas leaving discharge line 41, when particles of trichloroisocyanuric acid are dried is in the range from about 65° to about 110°, and preferably from about 80° to about 100° C. The cooled gas may still contain fine particles of the available halogen compound, and in this case, the cooled gas is passed through a scrubber (not shown) containing, for example, an aqueous solution of a compound such as an alkali metal hydroxide, an alkali metal carbonate or lime which chemically removes the available halogen compound before the gaseous fluid is discharged or recycled to the gas heat exchanger.

The particle size and free water content of the product may be varied by the control of temperature, feed rate and residence time in the dryer. Generally the particle size ranges from about 90 percent in the range of 30 to 200 microns but greater or larger size ranges may be obtained. The free water content of the dry product may range from about 0.01 to about 5 percent and is preferably less than about 1 percent by weight.

The pressure drop across the system is sufficient to maintain the circulating bed in the dryer and effect separation of the cooled gas from the dry solid product. This pressure drop is effected by the combination of the pressure applied by the heated gas through nozzles 30 and the suction applied through exhaust blower 30. However, the pressure at both of the points is adjusted to preferably provide a zero pressure drop across dryer feed inlet 22. As a result, wet particles are fed to dryer 10 without any need to provide equipment such as a seal to adjust for a pressure differential at this feed point.

The novel process of the present invention produces dry particles of available halogen compounds having a uniform particle size range and with minimal loss of the available halogen during drying. The process is suitable for drying wet particles of available chlorine compounds having a wide range of free water content and variation of particle size of the wet particles. Minimal drying periods are required to produce dry particles of available halogen compounds and down time due to dryer blockage is virtually eliminated.

The novel process of the present invention is further illustrated by the following examples without any intention of being limited thereby.

EXAMPLE 1

An aqueous slurry of trichloroisocyanuric acid was produced by the reaction of an aqueous sodium hypochlorite solution with a slurry of monosodium cyanurate. The trichloroisocyanuric acid slurry was filtered on a rotary vacuum filter to separate mother liquor from a wet cake of trichloroisocyanuric acid having a water content of about 13 percent by weight. The wet cake was continuously removed from the filter and fed to an inclined chute which fed a screw conveyor. Attrition of the wet cake in the chute and screw conveyor caused the formation of agglomerated particles of trichloroisocyanuric acid. The screw conveyor continuously fed these agglomerated wet particles of trichloroisocyanuric acid into a toroidal dryer of the type illustrated in FIG. 1.

The dryer was elliptical in shape having an overall width of approximately 6 feet 4 inches and a height of 8 feet 6 inches. A toroidal cross section was employed with exterior perimeter 12 having a width of 8 inches and interior perimeter 13 having a width of 17⅜ inches. Side perimeters 37 and 38 each had a length of about 20.6 inches. The distributor box 29 was positioned at bottom 16 of the dryer and conveyed heated gas at a temperature of about 190° C. from heated gas feed line 28 to 4 nozzles positioned tangentially around exterior perimeter 12 on bottom section 15 of the dryer. The heated air was fed at a pressure of 0.098 kilograms per square centimeter and at a velocity of 122 meters per second into the drying chamber. A circulating bed of dry particles of trichloroisocyanurate was established in the dryer by feeding wet particles through the dryer feed inlet 22 which is located on side 37 adjacent to bottom section 15 of the dryer.

Wet particles of trichloroisocyanuric acid containing about 13.2 percent moisture by weight was fed at the rate of about 3230 lbs. per hour. The evaporated load in the dryer was 422 lbs. of water per hour. The dry particles of trichloroisocyanurate retain less than 0.15 percent moisture and average 90.5 percent available chlorine. Approximately 90 percent of the particles were larger than 40 microns and less than 4 percent of the particles being larger than 150 microns. A product with relatively uniform particle size and uniform moisture content was obtained without significant loss of available chlorine and with substantially no evidence of caking or blockage of the dryer.

EXAMPLE 2

Dry particles of trichloroisocyanuric acid were mixed in a ribbon blender with sufficient water to produce 400 lbs. (dry basis) of a slurry having a moisture content of 15 percent by weight. The slurry was added to a screw feeder which fed the slurry to the toroidal dryer of EXAMPLE 1. The trichloroisocyanuric acid slurry was dried by the procedure of EXAMPLE 1 using heated air having an inlet temperature of about 205° C. being supplied at a pressure in the range of about 0.09 to 0.11 kg/sq. centimeter. Dry particles of trichloroisocyanuric acid recovered from the separator were sampled and no detectable moisture could be found. Available chlorine content was about 90 percent.

EXAMPLE 3

Using a procedure similar to EXAMPLE 2, 500 lbs. (dry basis) of a slurry of trichloroisocyanuric acid having 20 percent moisture content was prepared. The slurry was dried in the dryer of EXAMPLE 1 with heated air having an inlet temperature in the range of 176° to 200° C. supplied at pressures from about 0.09 to 0.111 kg/cm$^2$. Dry particles of trichloroisocyanuric acid recovered contained about 90 percent of available chlorine and about 0.2 percent moisture.

What is claimed is:

1. A process for drying wet particles of an available halogen compound selected from the group consisting of N-chloro organic compounds and N-bromo organic compounds which comprises:

a. forming a substantially vertical circulating bed of dried particles of said available halogen compound suspended in a heated gas in a circular annular zone, said zone having an exterior perimeter and an interior perimeter and having contiguous sections comprised of a top, a feed side, a bottom and a drying side, b. feeding wet particles of said available halogen compound into said circulating bed from the exterior perimeter of said feed side, c. feeding additional heated gas tangentially into said zone from the exterior perimeter of said bottom, at a temperature in the range from about 100° to about 220° C., the velocity of said heated gas being sufficient to maintain said circulating bed in said zone, d. withdrawing a product portion from said circulating bed from the interior perimeter of said feed side, downstream from said top, and e. recovering said dried particles of available halogen compound from said product portion.

2. The process of claim 1 wherein said available halogen compound is an N-chloro organic compound.

3. The process of claim 2 wherein said heated gas is selected from the group consisting of air and nitrogen.

4. The process of claim 3 wherein said wet particles contain from about 7 to about 30 percent by weight of water.

5. The process of claim 4 wherein said heated gas is at a temperature in the range from about 150° to about 205° C. when fed to said circulating bed.

6. The process of claim 5 in which said dry particles are at a temperature in the range from about 80° to about 100° C. when withdrawn from said circulating bed.

7. The process of claim 6 wherein said dry particles have a particle size range from about 30 to about 200 microns and a free water content of less than about 1.0 percent by weight.

8. The process of claim 7 in which said heated gas is air.

9. The process of claim 4 or 8 wherein said available chlorine compuond is selected from the group consisting of trichloroisocyanuric acid, sodium dichloroisocyanurate, cyanuric acid, and potassium dichloroisocyanurate.

10. The process of claim 4 or 8 wherein said available chlorine compound is trichloroisocyanuric acid.

11. The process of claim 4 or 8 wherein said available chlorine compound is sodium dichloroisocyanurate.

12. The process of claim n4 or 8 wherein said available chlorine compound is cyanuric acid.

13. The process of claim 4 or 8 wherein said available chlorine compound is potassium dichloroisocyanurate.

14. The process of claim 1 wherein said available bromine compound is selected from the group consisting of tribromoisocyanuric acid, and sodium dibromoisocyanurate.

15. The process of claim 4 or 8 wherein said available chlorine compound is trichloroisocyanuric acid and said wet particles contain from about 12 to about 15 percent by weight of free water.

* * * * *

UNITED STATES PATENT AND TRADEMARK OFFICE

CERTIFICATE OF CORRECTION

PATENT NO. : 4,489,503

DATED : December 25, 1984

INVENTOR(S) : James H. Browne, Robert H. Ward and Frank E. Albus

It is certified that error appears in the above-identified patent and that said Letters Patent is hereby corrected as shown below:

In Column 3, line 43, after "the" delete "eterior" and insert --exterior--.

In Column 4, line 64, delete "N-monobromo-C-dimethylhydantoin" and insert --N-monobromo-C,C-dimethylhydantoin--.

In Column 7, line 5, after "wet" delete "patticles" and insert --particles--.

In Column 10, Claim 9, line 2, after "chlorine" delete "compuond" and insert --compound--.

In Column 10, Claim 12, line 1, after "claim" delete "n4" and insert --4--.

Signed and Sealed this

*Thirtieth* Day of *July 1985*

[SEAL]

*Attest:*

DONALD J. QUIGG

*Attesting Officer* *Acting Commissioner of Patents and Trademarks*